US007841061B1

(12) United States Patent
Sorkin

(10) Patent No.: US 7,841,061 B1
(45) Date of Patent: Nov. 30, 2010

(54) METHOD OF FORMING A DEAD-END ANCHORAGE OF A POST-TENSION SYSTEM

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 626 days.

(21) Appl. No.: 11/862,636

(22) Filed: Sep. 27, 2007

(51) Int. Cl.
*B21D 39/00* (2006.01)
*B23P 11/00* (2006.01)
*B23P 19/02* (2006.01)
*E04C 5/08* (2006.01)

(52) U.S. Cl. ..... 29/452; 29/525; 29/525.01; 24/122.3; 24/122.6; 52/223.13

(58) Field of Classification Search ..... 29/452, 29/525, 525.01; 24/122.6, 115 R, 136 R, 24/115 M, 122.3; 52/223.13
See application file for complete search history.

(56) References Cited

U.S. PATENT DOCUMENTS 3,099,109 A * 7/1963 Hahn ..... 52/223.13
4,724,639 A * 2/1988 Moser ..... 52/223.13
5,630,301 A * 5/1997 Sieg ..... 52/223.13
5,770,286 A 6/1998 Sorkin
5,839,235 A 11/1998 Sorkin
5,897,102 A * 4/1999 Sorkin ..... 254/29 A
6,098,356 A 8/2000 Sorkin
6,381,912 B1 5/2002 Sorkin
6,631,596 B1 10/2003 Sorkin
6,817,148 B1 11/2004 Sorkin
7,614,134 B2 * 11/2009 Messein et al. ..... 29/525
2002/0178665 A1 * 12/2002 Campbell ..... 52/223.13

* cited by examiner

*Primary Examiner*—Jermie E Cozart
(74) *Attorney, Agent, or Firm*—Egbert Law Offices PLLC

(57) ABSTRACT

A method of forming a dead-end anchorage of a post-tension anchor system includes the steps of positioning a tendon within a cavity of an anchor body such that an unsheathed end of the tendon extends outwardly of the cavity such that a sheathed portion of the tendon is positioned within the cavity, mechanically inserting a fixing element into the cavity, mechanically inserting wedges into the cavity between the unsheathed end of the tendon and a wall of the cavity, and applying pressure onto an end of the tendon such that the fixing element engages the sheathed portion and such that the tendon and the wedges are in interference-fit relationship within the cavity. The fixing element includes a pair of fixing members positioned adjacent an end of the wedges.

20 Claims, 3 Drawing Sheets

METHOD OF FORMING A DEAD-END ANCHORAGE OF A POST-TENSION SYSTEM

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to dead-end anchorages. More particularly, the present invention relates to methods that are used to mechanically secure the end of a tendon within an interior cavity of an anchor. Additionally, the present invention relates to a method of forming dead-end anchorages which serves to prevent sheathing shrinkage on the tendon at the dead-end anchor.

2. Description of Related Art Including Information Disclosed Under 37 CFR 1.97 and 37 CFR 1.98.

For many years, the design of concrete structures imitated the typical steel design of column, girder and beam. With technological advances in structural concrete, however, concrete design began to evolve. Concrete has the advantages of costing less than steel, of not requiring fireproofing, and of having plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economical and popular. Reinforced-concrete framing is seemingly a simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, comprising a mixture of water, cement, sand, and stone or aggregate and having proportions calculated to produce the required strength, is set, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as five hundred feet can be attained in members as deep as three feet for roof loads. The basic principle is simple. In pre-stressing, reinforcing tendons of high tensile strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

In typical post-tension systems, the tendon is received between a pair of anchors. One of the anchors is known as the "live-end" anchor, and the opposite end is known as the "dead-end" anchor. The "live-end" anchor receives the end of the tendon which is to be tensioned. The "dead-end" anchor holds the tendon in place during the tensioning operation. Under typical operations, a plurality of wedges are inserted into an interior passageway of the anchor and around the exterior surface of the tendon. The tendon is then tensioned so as to draw the wedges inwardly into the interior passageway so as establish compressive and locking contact with an exterior surface of the tendon. This dead-end anchor can then be shipped, along with the tendon, for use at the job site.

One technique for forming such dead-end anchors is to insert the end of a tendon into the cavity of the anchor, inserting wedges into the space between the tendon and the wall of the cavity, and then applying a tension force onto another end of the tendon so as to draw the wedges and the end of the tendon into the cavity in interference-fit relationship therewith. This procedure is somewhat difficult since the tendon can have a considerable length and since the use of tension forces can create a somewhat unreliable connection between the wedges and the tendon. Experimentation has found that the application of compressive force onto the end of the tendon creates a better interference-fit relationship between the wedges, the end of the tendon and the wall of the cavity of the anchor.

Another technique is described in U.S. Pat. No. 6,513,287, issued on Feb. 4, 2003 to the present inventor. This patent describes a method and apparatus for forming an anchorage of a post-tension system in which a tendon is positioned within a cavity of the anchor such that an end of the tendon extends outwardly of the cavity. A plurality of wedges are mechanically inserted within the cavity between the tendon and a wall of the cavity. Pressure is applied to an end of the tendon such that the tendon and the wedges are in interference-fit relationship within the cavity. A compression mechanism is used having a cylindrical member and a plunger extending in a channel of the cylindrical member. The wedges are attached to the cylindrical member and the cylindrical member is moved toward the cavity such that the wedges enter a space between the tendon and the wall of the cavity. The plunger applies a compressive force to the end of the tendon when the end of the tendon is in the channel of the cylindrical member.

One of the problems with conventional dead-end anchorages is that the sheathing over the tendon has a tendency to shrink over time. The shrinkage is the result of various factors. One major factor is that the sheathing is formed over the tendon in an extrusion process. As such, the polymeric material used for the sheathing is relatively hot as it exits the extrusion process. Immediately after leaving the extrusion process, the tendon, along with the sheathing, are tightly wound around a spool. During shipment, the tight winding of the tendon around the spool will mechanically resist any shrinking of the sheathing over the lubricated exterior of the steel cable on the interior of the tendon. When the cable is unwound from the spool, these mechanical forces are released. As such, as the tendon is installed in an anchor, the relaxation of these mechanical forces will generally and slowly cause the sheathing to shrink over the length of the tendon. After the tendon is connected to a dead end anchorage, the end of the sheathing will tend to the shrink slowly away from the dead end anchorage.

The problem that affects many anchorage system is the inability to effectively prevent liquid intrusion into this area of the unsheathed portion. In normal practice, a liquid-tight tubular member is placed onto an end of the tendon so as to cover an unsheathed portion of the tendon. The tubular member slides onto and over the trumpet portion of the encapsulated anchor so as to be frictionally engaged with the trumpet portion of the anchor. The opposite end of the tubular member will include a seal that establishes a generally liquid-tight connection with the sheathed portion of the tendon.

In the past, various patents have issued to the present inventor relating to such corrosion-protection tubes. These patents were developed for the purpose of accommodating the natural shrinkage of the sheathing over the lubricated cable. For example, U.S. Pat. No. 5,839,235, issued on Nov. 20, 1998 to the present inventor, describes a corrosion protection tube for a post-tension anchor system. A tubular body is affixed in snap-fit engagement with the trumpet portion so as to extend outwardly from the trumpet portion in axial alignment therewith. The tubular body has a seal at an end opposite the trumpet portion so as to form a generally liquid-tight seal with an exterior surface of the tendon. The tubular body has a notch formed on an exterior surface thereof. The trumpet portion has an inwardly extending surface. The inwardly extending surface engages the notch so as to form a generally liquid-tight connection. A collar extends around the tubular body on a side of the notch so as to be in close relationship to the end of the trumpet portion.

U.S. Pat. No. 6,631,596, issued on Oct. 14, 2003 to the present inventor, teaches another corrosion protection tube for use on an anchor of a post-tension anchor system. This corrosion protection tube has a connection portion at one end and a sealing portion on an opposite end. The anchor has a trumpet portion with a notch extending therearound. The connection portion includes an inwardly extending surface for engagement with the notch of the trumpet portion. The sealing portion is in liquid-tight engagement with the sheathed portion of the tendon. Alternatively, the connection portion includes an additional inner sleeve so as to define an annular slot with the inwardly extending surface. The inner sleeve extends into the interior of the trumpet portion so that the inner sleeve and the trumpet portion are in a liquid-tight engagement.

U.S. Pat. No. 6,817,148, issued on Nov. 16, 2004 to the present inventor, describes another type of corrosion protection seal for the anchor of a post-tension anchor system. A seal member is affixed to an end of the tubular portion of the anchor opposite the anchor body. The seal member has a portion extending around the sheathed portion of the tendon in generally liquid-tight relationship therewith. The tubular portion has an interlock area extending therearound for engaging an interior surface of the seal member. The tubular portion has a length of generally greater than four inches extending outwardly of the anchor body.

U.S. Pat. No. 5,770,286, issued on Jun. 23, 1998 to the present inventor, shows a corrosion inhibitor retaining seal. This seal includes a cap having a tubular body and a surface extending across the surface of the tubular body. A corrosion-resistant material is contained within the interior area of the cap. This surface closes the end of the tubular body. A frangible area is formed on this surface. The surface extends transverse to a longitudinal axis of the tubular body at one end of the tubular body. The frangible area has a thickness less than a thickness of a non-frangible remainder of the surface. The cap is formed of a polymeric material. The surface is formed of a deformable polymeric material such that the non-frangible portion of the surface forms a liquid-tight seal with an outer diameter of a tendon extending through the surface. The corrosion-resistant material is contained within the cap of a suitable volume so as to fill a void in the tubular member between the inner diameter of the tubular member and the outer diameter of a tendon extending therethrough.

U.S. Pat. No. 6,098,356, issued on Aug. 8, 2000 to the present inventor, shows a method and apparatus for sealing an intermediate anchorage of a post-tension system. This apparatus has a cap with an attachment section thereon. The attachment section is adapted to allow the cap to be connected to an end of the anchor body. The cap has a tubular member extending outwardly from the attachment section. The tubular member has an opening at an end opposite the attachment section. The cap also has a grease fitting formed thereon. The grease fitting is adapted so as to allow grease to be introduced into the interior passageway of the tubular member. The attachment section and the tubular member are integrally formed together of a polymeric material. A seal is affixed to the open end of the tubular member so as to form a liquid-tight seal over the sheathed portion of a tendon extending therethrough.

U.S. Pat. No. 6,381,912, issued on May 7, 2002 to the present inventor, also shows a method of sealing the intermediate anchor of a post-tension system. An elastomeric seal has one end affixed to the anchor member and extending outwardly therefrom. A rigid ring member is detachably received within an opposite end of the seal. The ring member has an inner diameter greater than an outer diameter of the tendon. The opposite end of the seal is in liquid-tight compressive contact with the exterior surface of the tendon when the ring member is detached from the seal. The interior passageway of the anchor, the seal and the ring member have an inner diameter, when joined together, which is larger than the outer diameter of the tendon so as to allow the anchor member, the seal and the ring member to slide along the length of the tendon.

As can be seen, there is a great deal of technology associated with this need to accommodate the shrinkage of the sheathing over the cable of the tendon of the post-tension anchor system. Each of this technology suggests the placement of an additional tube over the polymeric encapsulation and additional materials for sealing the unsheathed portion of the tendon which extends outwardly of the anchor. In certain circumstances, these tubes are sometimes improperly installed and, at best, are simply an additional component that needs to be associated with the post-tension system. As such, it adds additional costs and can require additional labor associated with the installation of the sealing tube. As such, a need has developed so as to avoid the use of such a tube with the dead-end anchor of a post-tension anchor system.

It is an object of the present invention to provide a method for forming a dead-end anchorage which installs the tendon in the anchor by compressive forces.

It is another object of the present invention to provide a method for forming a dead-end anchorage which prevents sheathing shrinkage at the dead-end anchorage.

It is another object of the present invention to provide a method for forming a dead-end anchorage which eliminates any buckling of the end of the tendon during compression fitting.

It is further object of the present invention to provide a method for forming a dead-end anchorage which is safe, easy to use and relatively in expensive.

It is still another object of the present invention to provide a method of forming a dead-end anchorage which avoids the need to secure corrosion protection tubes over the sheathing extending outwardly from the anchor.

These and other objects and advantages of the present invention will become apparent from a reading of the attached specification and appended claims.

BRIEF SUMMARY OF THE INVENTION

The present invention is a method of forming a dead-end anchorage of a post-tension anchor system. This method includes the steps of: (1) positioning a tendon within a cavity of an anchor body such that an unsheathed end of the tendon extends outwardly of the cavity and such that a sheathed portion of the tendon is positioned within the cavity; (2) mechanically inserting a fixing element into the cavity; (3) mechanically inserting wedges into the cavity between the unsheathed end of the tendon and a wall of the cavity; and (4) applying pressure onto an end of the tendon such that the fixing element engages the sheathed portion and such that a the tendon and the wedges are in interference-fit relationship within the cavity.

In the method of the present invention, the step of mechanically inserting a fixing element includes positioning the fixing element adjacent an end of the wedges with the cavity. The step of applying pressure includes drawing the fixing element and the wedges into the cavity by then pressure applied onto the end of the tendon.

In the present invention the cavity has a tapered portion with a wide end opening at one end of the anchor body and a narrow end interior of the cavity. The cavity has a passageway extending from the narrow end to an opposite end of the anchor body. The step of positioning includes positioning the sheathed portion within this passageway. Pressure is applied onto an end of the tendon such that the fixing element engages the sheathed portion within this passageway.

In the preferred embodiment of the present invention the fixing element is a pair of clip members. The step of applying pressure includes applying pressure onto an end of the tendon such that the pair of clip members is interposed between an exterior of the sheathed portion and a wall of the passageway. Each of the pair of clip members has a pointed end. Pressure is applied so that the pointed end of the pair of clip members bites into the sheathing of the sheathed portion of the tendon.

The wedges are formed such that the fixing element is at an end of the wedges. In one form of the present invention, the wedges are formed such that the fixing element is integral with the wedges. Alternatively, the fixing elements can simply be separate from the wedges or releasably attached to the wedges.

The method of the present invention further includes forming a compression mechanism having a cylindrical member and a plunger interior of the cylindrical member. The plunger is axially movable through an interior space of the cylindrical member. The step of applying pressure includes moving the cylindrical member toward the cavity such that the end of the tendon resides within the interior space of the cylindrical member and moving the plunger toward the end of the tendon such that an end of the plunger applies pressure onto the end of the tendon within the space. The anchor body is affixed within a fixture such that a wide end of the cavity will face the wedges.

DETAILED DESCRIPTION OF THE INVENTION

Figure 1:
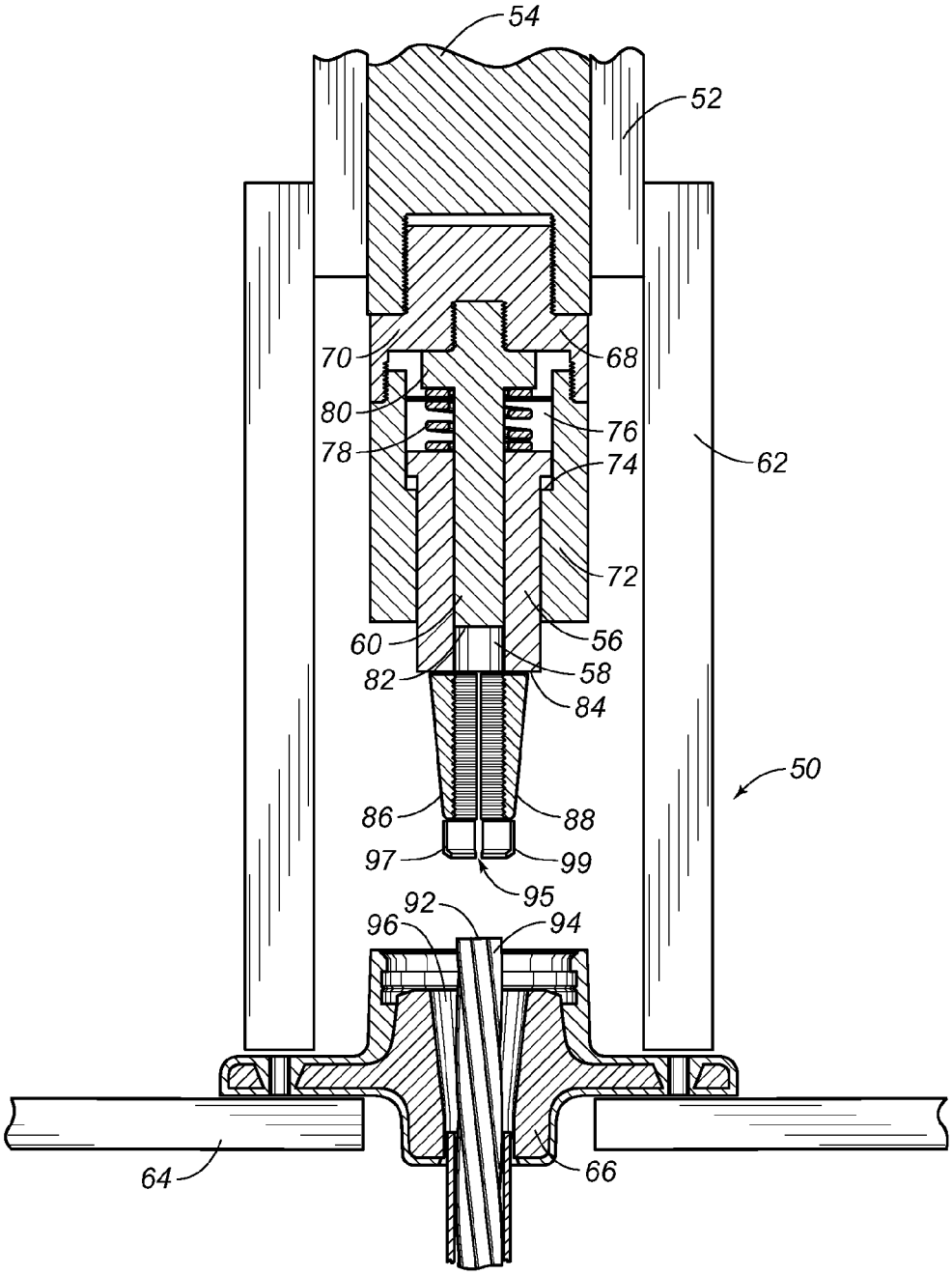
FIG. 1 is a cross-sectional view showing the initial stage of the method of the present invention.

Referring to FIG. 1, there is shown the apparatus 50 for the formation of a dead-end anchorage. The apparatus 50 includes a housing 52, a piston member 54 positioned within the housing 52, a cylindrical member 56 connected to the piston member 54 and having an interior channel 58 therein and a plunger 60 movable within the channel 58 of the cylindrical member 56. A frame 62 can be connected to the housing 52 and extend outwardly therefrom. A fixture 64 is provided so as to allow the anchor 66 to be positioned in a proper position relative to the apparatus 50.

The housing 52 can be part of a hydraulic or pneumatic system whereby a suitable force can be applied such that the piston member 54 is movable relative to the housing 52. Suitable hydraulic or pneumatic connections can be connected to the housing 52 so as to properly impart the desired motion to the piston member 54. The piston member 54 is axially movable within the housing 52. A holder member 68 is connected to the piston member 54. The holder member includes a connector 70 affixed to the end of the piston member 54 and a support section 72 connected to the connector 70. The cylindrical member 56 is slidably disposed within the interior of the support section 72. The support section 72 will have a generally tubular configuration. A shoulder 74 is formed on the interior of the support section 72 so as to provide a stop to the slidable movement of the cylindrical member 56.

The cylindrical member 56 is shown as received within the interior area 76 of the support section 72. A spring 78 is connected to an end of the cylindrical member 56 such that the cylindrical member 56 is resiliently mounted within the interior 76 of the support section 72. The cylindrical member 56 includes a channel 58 extending axially therethrough. The channel 58 is a space in which the plunger 60 can move relative to the cylindrical member 56. In normal use, and without contact onto another surface, the cylindrical member 56 will move with the movement of the piston member 54.

The plunger 60 has one end connected to the connector 70 associated with the piston member 54. The plunger 60 has a widened annular portion 80 which resides against a surface of the holder member section 68. The annular portion 80 also provides an abutment surface for an end of the spring 78. Spring 78 provides a resilient connection between the cylindrical member 56 and the plunger 60. The plunger 60 has an end 82 residing within the channel 58 inwardly of the end 84 of the cylindrical member 56.

Figure 2:
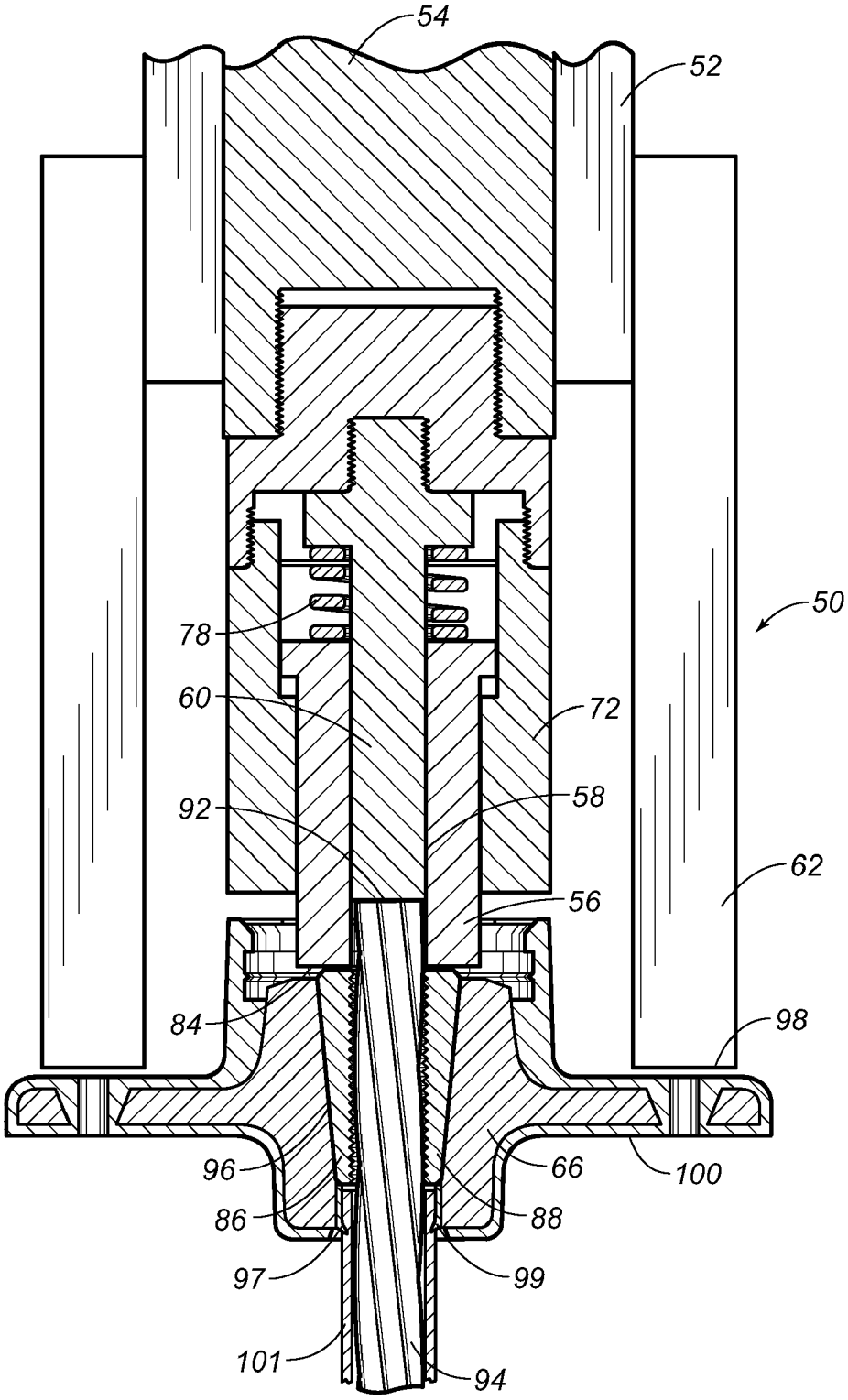
FIG. 2 is a cross-sectional view showing the later stage of the method of the present invention.

As can be seen in FIG. 2, wedges 86 and 88 are connected to the end 84 of the cylindrical member 56. In the preferred embodiment of the present invention, the end 84 of the cylindrical member 56 is suitably magnetic so that the wedges 86 and 88 can be magnetically secured thereto. In alternative forms of the present invention, the end 84 of the cylindrical member 56 can have a suitable connector so that the wedges 86 and 88 can be mechanically secured thereto. As can be seen, the wedges 86 and 88 will define an interior passage to which the end 92 of the tendon 94 will pass. The wedges 86 and 88 are positioned so as to face the cavity 96 of the anchor 66.

In FIG. 1, it can be seen that fixing elements 95 are positioned adjacent to the end of the wedges 86 and 88. The fixing elements 95 can be in the form of clip members 97 and 99. These clip members 97 and 99 can be magnetically secured to the end of the wedges 86 and 88, or simply inserted into the cavity 96 of the anchor 66. Still further, and alternatively, the clip members 97 and 99 can be integrally formed with the wedges 86 and 88 so as to move concomitantly with the movement of the wedges 86 and 88. As used herein, the term "clip members" can refer to various structures. Preferably, in the preferred embodiment of the present invention, as will be described hereinafter, each of the clip members has a pointed end which is designed so as to bite or engage the sheathing of the tendon. Alternatively, the fixing elements 95 can be in the form of wedges that are urged in the space between the sheathing and the tendons so as to frictionally cause the sheathing to be interposed between the outer surfaces of the wedges and the inner surface of the wall of the cavity. Various techniques can be employed whereby the fixing elements 95 can be installed properly within the passageway at the end of the tapered portion of the cavity of the anchor body.

As can be seen in FIG. 1, the present invention allows the wedges 86 and 88 to be simply placed onto the end 84 of the cylindrical member 56. The magnetic attraction between the end 84 of the cylindrical member 56 will maintain the wedges 86 and 88 in their desired position. Although it is possible, it is not necessary for the worker to manually install the wedge 86 and 88 into the cavity 86. Similarly, it is not necessary for the worker to manually install the clip members 97 and 99 into the passageway of the cavity of the anchor. The present invention improves safety because the wedge 86 and 88 do not have to be installed in a confined space between the hydraulically actuated plunger 60 and the anchor 66.

FIG. 2 shows a later stage of the present invention. As shown in FIG. 2, the piston member 54 has been suitably actuated by hydraulic mechanisms. This will cause the piston member 54 to move relative to the housing 52. As a result, the support section 72 is moved toward the anchor 66. In particular, it can be seen that the wedges 86 and 88 have been fully inserted within the wedge cavity 96 of the anchor 66. Additionally, the clip members 97 and 99 are inserted so as to engage the sheathing of the tendon. During this installation process, the end 92 of the tendon 94 enters the channel 58 with cylindrical member 56. The continued pressurized movement of the piston member 54 will cause the plunger 60 to exert strong pressures onto the end 92 of tendon 94. This will create a strong interference-fit relationship between the tendon 94, the wedges 86 and 88, and the wall of the wedge cavity 96. The movement of the wedges 86 and 88 will be suitably limited by the resilient mounting of the cylindrical member 56 within the support section 72. The spring 78 will resist the retracting movement of the cylindrical member 56 to a limited extent. When the force of the spring 78 is overcome, then the wedges 86 and 88 will reside in their desired position within the cavity 96. In this circumstance, the plunger 60 can continue to move within the channel 58 so as to effect the connection of the tendon 94 within the dead-end anchor 66. As the wedges 86 and 88 are moved into the position illustrated in FIG. 2, the bottoms ends of the wedges 86 and 88 will urge the clip members 97 and 99 into their position in engagement with the sheathing 101 of the tendon 94. The pointed end of each of the clip members 97 and 98 will bite into the sheathing 101. The remainder of the clip members 97 and 99 will be interposed between the inner wall of the passageway at the end of the tapered portion of the cavity 96 and the exterior surface of the sheathing 101.

After installation, the piston member 54 can be suitably retracted so that the end 92 of the tendon 94 moves outwardly of the channel 58 within the cylindrical member 56. In case the end 92 of the tendon 94 is hung up in the channel 58, the frame 62 includes an abutment surface 98 contacting the flange portion 100 of the anchor 66. This will resist the movement of the anchor 66 along with the retracting piston member 54. The anchor 66 can then be removed from its fixture 64 with its dead-end anchorage properly installed.

In the present invention, the possibility of the buckling of the end 92 of the tendon 94 is presented by the small clearance between the wall of the channel 58 and the exterior surface of the end 92 of tendon 94. The relationship between the plunger 60 and the cylindrical member 56 assures a proper metering of the distance in which the ends 92 of tendon 94 extends outwardly of the end of the wedges 86 and 88. The direct application of pressure only onto the end 92 of the tendon 94 provides the ultimate connection method. Experimentation has shown that the strongest connection technique is when the tendon 94 expands within the cavity 96 so as to force the wedges 86 and 88 outwardly into interference-fit relationship with the wall of the cavity 96. This is superior to the prior art in which pressure is applied to both the wedges and to the tendon, simultaneously, for installation purposes.

Figure 3:
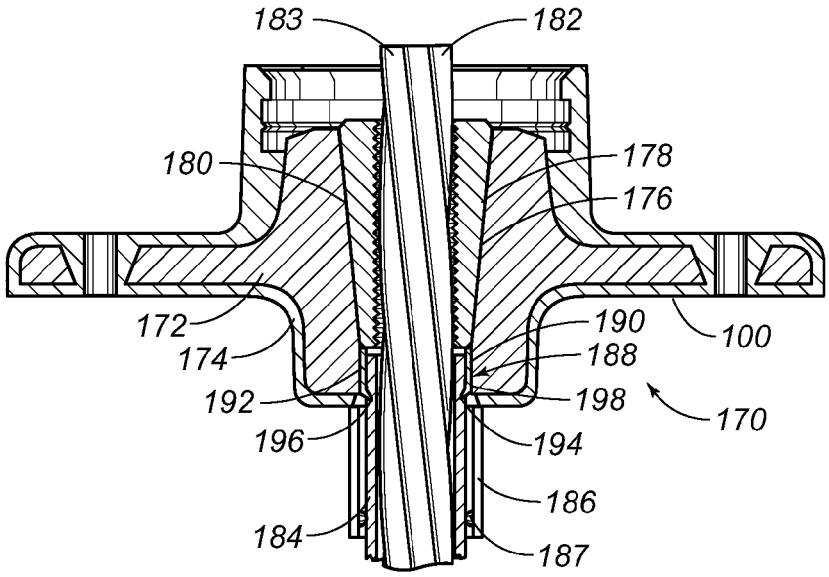
FIG. 3 is a cross-sectional end view showing the dead-end anchorage which was assembled by the method of the present invention.

FIG. 3 is a cross-sectional view of the post-tension anchor system 170 as installed by the method of the present invention. As can be seen, the post-tension anchor 170 includes an anchor body 172 that is encapsulated with a polymeric encapsulation 174. The wedge cavity 176 extends through the interior of the anchor body 172. Wedges 178 and 180 are positioned within this tapered wedge cavity 176 so as to be in strong engagement with an unsheathed portion 183 of the tendon 182. A sheathing 184 extends outwardly through a polymeric trumpet 186 formed with the polymeric encapsulation 174 so as to extend outwardly from the end of the anchor body 172. The trumpet portion 186 includes an annular seal 187 that is positioned on the interior of the trumpet 186 so as to be in liquid-tight sealing engagement with the exterior surface of the sheathing 184.

As can be seen in FIG. 3, the cavity 176 of anchor body 172 includes a tapered portion and a passageway 198. Passageway 198 extends from the narrow end of the wedge cavity 176 to the end of the anchor body 172. The fixing elements 188 are positioned at the end of the wedges 178 and 180 and are generally interposed between the outer surface of the sheathing 184 and the wall of passageway 198. The fixing elements 188 include a first clip member 190 and a second clip members 192. Each of these clip members 190 and 192 includes a pointed end 194 and 196. When the strong forces are applied so as to cause the wedge 178 and 180 to be properly in position, these forces will urge the pointed ends 194 and 196 of the clip members 190 and 192, respectively, into a biting engagement with the sheathing 184 on the tendon 182. The strong biting forces will grip the end of the sheathing 184 so as to prevent shrinkage from occurring.

It should be noted that the force of shrinkage is between 100 and 125 p.s.i. On the other hand, the force required to properly engage the wedges 178 and 180 with the unsheathed portion 183 of tendon 182 is on the order of 2500 p.s.i. As such, the biting forces imparted by the clip members 190 and 192 into the sheathing 184 should be sufficient to overcome the shrinkage forces. In this manner, the end of the sheathing 184 within the passageway 190 will be retained within the passageway. As such, the present invention is able to form a dead-end anchorage without the need for installing tubing or other items onto the trumpet 186 of the encapsulation 174 on anchor body 172.

Figure 4:
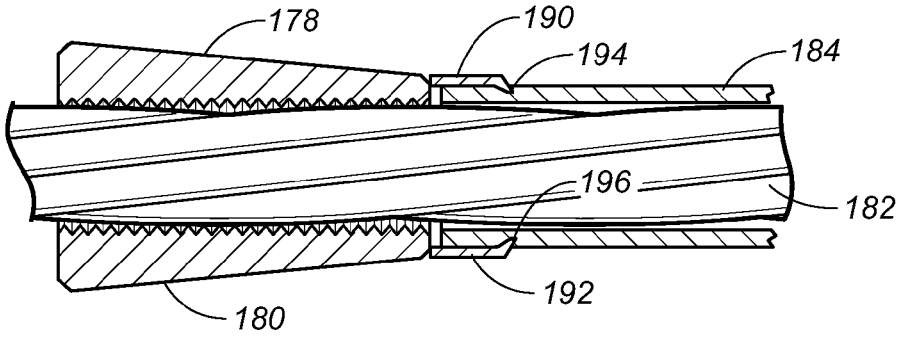
FIG. 4 is a close-up cross-sectional view of the fixing element as secured to the sheathing of the tendon.

FIG. 4 shows a detailed view of how the clip members 190 and 192 engage with the sheathing 184 on tendon 182. Each of the clip members 190 and 192 includes a pointed end 194 and 196, respectively. Each of the clip members 190 and 192 is fastened to, abutting, or integrally formed with the respective wedges 178 and 180. The pointed ends 194 and 196 are shown as strongly engaging the sheathing 184 and, in fact, penetrate the surface of the sheathing 184. The strong interposition of the clip members 190 and 192 against the wall of passageway 194, along with their engagement with the sheathing 184 will further provide a barrier to liquid intrusion into the cavity 176 of the anchor body 172.

Figure 5:
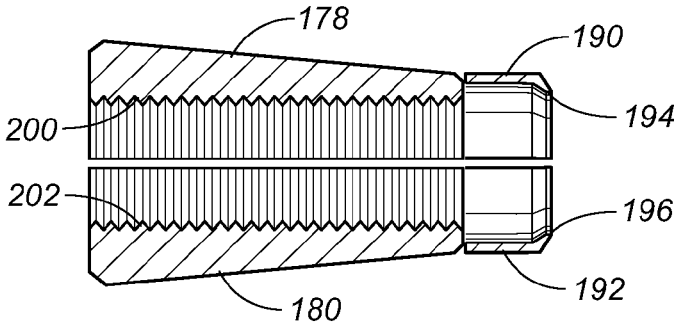
FIG. 5 is a cross-sectional view showing the wedges and clip members as used in the method of the present invention.

FIG. 5 shows an isolated view of the wedges 178 and 180, along with the clip members 190 and 192. The pointed end 194 and 196 extend inwardly from the ends from the clip members 190 and 192, respectively. In FIG. 5, it can be seen that the clip members 190 and 192 are integrally formed with the wedges 178 and 180. Each of the wedges 178 and 180 includes teeth 200 and 202 extending therealong. These teeth 200 and 202 will facilitate the engagement of the wedges 178 and 180 with the unsheathed portion of the tendon. The clip members 190 and 192 extend outwardly from the end of the wedges 178 and 180.

The foregoing disclosure and description of the invention is illustrative and explanatory thereof. Various changes in the details of the described method can be made within the scope of the appended claims without departing from the true spirit of the invention. The present invention should only be limited by the following claims and their legal equivalents.

I claim:

1. A method of forming a dead-end anchorage of a post-tension anchor system comprising:

positioning a tendon within a cavity of an anchor body such that an unsheathed end of said tendon extends outwardly of said cavity, said tendon having a sheathing extending at least partially therearound, said tendon having a sheathed portion positioned within said cavity;

mechanically inserting a fixing element into said cavity;

mechanically inserting wedges into said cavity between said unsheathed end of said tendon and a wall of said cavity; and applying pressure onto an end of said tendon such that said fixing element engages said sheathed portion and such that said tendon and said wedges are in interference-fit relationship within said cavity.

2. The method of claim 1, the step of mechanically inserting a fixing element comprising:

positioning said fixing element adjacent an end of said wedges within said cavity.

3. The method of claim 1, said step of applying comprising:

drawing said fixing element and said wedges into said cavity by the pressure applied onto said end of said tendon.

4. The method of claim 1, said cavity having a tapered portion with a wide end opening at one end of said anchor body and a narrow end interior of said cavity, said cavity having a passageway extending from said narrow end to an opposite end of said anchor body, said step of positioning comprising:

positioning said sheathed portion within said passageway.

5. The method of claim 4, said step of applying pressure comprising:

applying pressure onto said end of said tendon such that said fixing element engages said sheathed portion within said passageway.

6. The method of claim 5, said fixing element being a pair of clip members, said step of applying pressure comprising:

applying pressure onto said end of said tendon such that said pair of clip members are interposed between an exterior of said sheathed portion and a wall of said passageway.

7. The method of claim 6, each of said pair of clip members having a pointed end, said step of applying pressure comprising:

applying pressure onto said end of said tendon such that said pointed end of said pair of clip members bite into said sheathing of said sheathed portion of said tendon.

8. The method of claim 5, further comprising:

forming said wedges such that said fixing element is at an end of said wedges.

9. The method of claim 8, said step of forming said wedges comprising:

forming said wedges such that said fixing element is integral with said wedges.

10. The method of claim 1, further comprising:

forming a compression mechanism having a cylindrical member and a plunger interior of said cylindrical member, said plunger being axially movable through an interior space of said cylindrical member.

11. The method of claim 10, said step of applying pressure comprising:

moving said cylindrical member toward said cavity such that said end of said tendon resides within said interior space of said cylindrical member; and moving said plunger toward said end of said tendon such that an end of said plunger applies pressure onto said end of said tendon within said interior space.

12. The method of claim 1, further comprising:

affixing said anchor body within a fixture such that a wide end of said cavity faces said wedges.

13. A method of forming a dead-end anchorage of a post-tension system comprising:

positioning a tendon within a cavity of an anchor body such that an unsheathed end of said tendon extends outwardly of said cavity, said tendon having a sheathing extending at least partially therearound, said tendon having a sheathed portion positioned within said cavity;

mechanically inserting a fixing element into said cavity;

mechanically inserting wedges into said cavity between said unsheathed end of said tendon and a wall of said cavity; and applying pressure onto said wedges such that said wedges urge said fixing element onto engagement with an end of said sheathed portion such that said wedges are in interference-fit relationship within said cavity.

14. The method of claim 13, said step of applying pressure comprising:

applying pressure onto an end of said tendon such that said fixing element and said wedges are urged into said cavity by the pressure applied onto said end of said tendon.

15. The method of claim 13, said cavity having a tapered portion with a wide end opening at one end of said anchor body and a narrow end interior of said cavity, said cavity having a passageway extending from said narrow end to an opposite end of said anchor body, said step of positioning comprising:

positioning said sheathed portion within said passageway.

16. The method of claim 15, said step of applying pressure comprising:

applying pressure onto an end of said tendon such that said fixing element engages said sheathed portion within said passageway.

17. The method of claim 16, further comprising:

forming said wedges such that said fixing element is at an end of said wedges.

18. The method of claim 17, said step of forming comprising:

forming said wedges such that said fixing element is integral with said wedges.

19. The method of claim 16, said fixing element being a pair of clip members, said step of applying pressure comprising:

applying pressure onto an end of said tendon such that said pair of clip members are interposed between an exterior of said sheathed portion and a wall of said passageway.

20. The method of claim 19, each of said pair of clip members having a pointed end, said step of applying pressure comprising:

applying pressure onto said end of said tendon, such that said pointed end of said pair of clip members bite into said sheathing of said sheathed portion of said tendon.

* * * * *